US005145096A

United States Patent [19]

Stenger

[11] Patent Number: 5,145,096

[45] Date of Patent: Sep. 8, 1992

[54] SLIDE-ON TAP FOR A BEVERAGE CONTAINER

[75] Inventor: Tracy K. Stenger, Rockford, Ill.

[73] Assignee: Johnson Enterprises, Inc., Rockford, Ill.

[21] Appl. No.: 742,366

[22] Filed: Aug. 8, 1991

[51] Int. Cl.[5] ..... B65D 83/00

[52] U.S. Cl. ..... 222/400.8; 222/399; 137/212; 251/149; 285/325; 285/396; 403/93

[58] Field of Search ..... 222/399, 400.5, 400.7, 222/400.8; 137/212; 251/148, 149; 285/325, 326, 361, 396; 403/70, 80, 93

[56] References Cited

U.S. PATENT DOCUMENTS

| | | | |
|---|---|---|---|
| 3,511,417 | 5/1970 | Rousset | 222/400.7 |
| 4,717,048 | 1/1988 | Stenger | 222/400.8 |
| 4,728,010 | 3/1988 | Johnston | 222/400.8 X |
| 4,828,147 | 5/1989 | Wiedmann et al. | 222/400.8 X |

FOREIGN PATENT DOCUMENTS

| | | | |
|---|---|---|---|
| 2502192 | 7/1976 | Fed. Rep. of Germany | 222/400.7 |
| 2601757 | 7/1976 | Fed. Rep. of Germany | 222/400.7 |
| 2531697 | 2/1977 | Fed. Rep. of Germany | 222/400.8 |

*Primary Examiner*—Michael S. Huppert
*Assistant Examiner*—Anthoula Pomrening
*Attorney, Agent, or Firm*—Leydig, Voit & Mayer

[57] ABSTRACT

The tap includes a lower body adapted to slide radially onto the neck of a container and lock beneath a lip on the neck. Connected pivotally to the lower body is an upper body having means for opening valves in the neck when the upper body is swung downwardly relative to the lower body to a tapping position. A releasable latch is carried by a handle on the upper body and automatically latches the upper body downwardly against the lower body when the upper body reaches its tapping position.

10 Claims, 3 Drawing Sheets

SLIDE-ON TAP FOR A BEVERAGE CONTAINER

BACKGROUND OF THE INVENTION

This invention relates to a tap for a container such as a beer keg. More specifically, the invention relates to a tap for a keg having a fitting known as a Sankey-type fitting. Such a fitting includes a tubular neck having valve means which normally close the container to hold the beer under pressure in the container. The tap includes a probe adapted to be telescoped into the neck to open the valve means and permit pressurized gas to be injected into the keg while permitting beer to be dispensed from the keg. When the tap is coupled to the fitting, the probe is automatically sealed within the neck to prevent leakage around the fitting.

In some respects, the present tap is similar to that disclosed in Stenger U.S. Pat. No. 4,717,048 in that the present tap locks beneath an external lip on the neck of the keg and places no reliance on the conventional internal locking lugs of the Sankey-type fitting. By virtue of the tap locking onto the external lip, the tap does not damage the conventional internal locking lugs and may be used even on kegs whose lugs have been previously damaged.

The tap disclosed in the aforementioned Stenger patent has experienced significant commercial success. That tap does, however, require several components and thus is somewhat expensive to manufacture and assemble. Also, the tap disclosed in the Stenger patent relies on the camming action of a radially contractible collar to force the probe downwardly and effect opening of the valve means of the fitting. In some cases, tolerance stack-ups result in the probe being forced downwardly through only a relatively short stroke by the camming action of the collar.

SUMMARY OF THE INVENTION

The general aim of the present invention is to provide a new and improved tap which possesses virtually all of the advantages of the prior Stenger tap but which requires significantly fewer components and thus lends itself to more economical manufacture and assembly.

A related object of the invention is to provide a tap whose probe may be forced downwardly through a longer stroke thereby to insure full opening of the valve means of the fitting and enable the tap to be used more reliably in $CO_2$ dispensing systems.

Still another object is to provide a tap which may be installed loosely on the keg with a simple slide-on motion which is followed by an equally simple pivoting motion in order to open the valve means of the fitting and to lock the tap securely to the keg.

The invention also resides in the relatively simple three-piece construction of the tap and in the unique manner in which the pieces are simply snapped together for purposes of assembly.

These and other objects and advantages of the invention will become more apparent from the following detailed description when taken in conjunction with the accompanying drawings.

DETAILED DESCRIPTION OF THE PREFERRED EMBODIMENT

Figure 1:
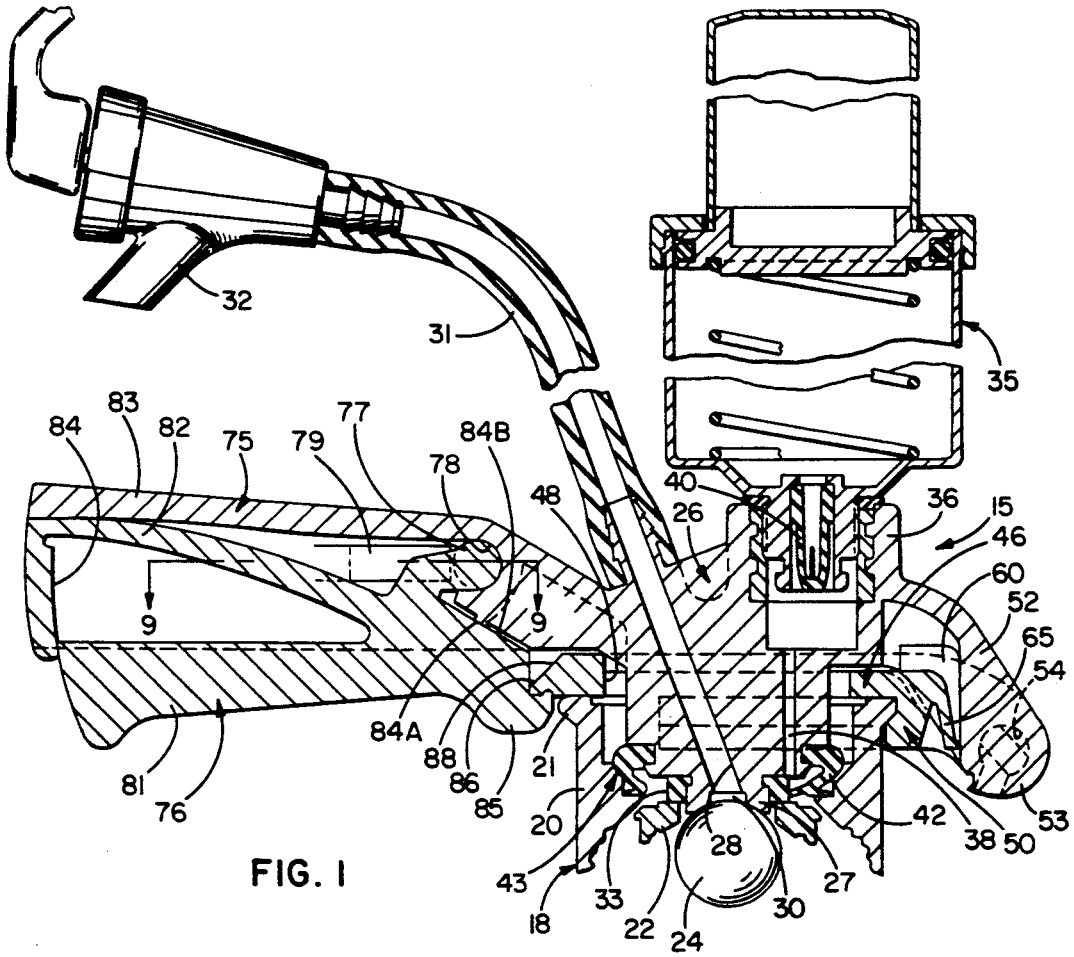
FIG. 1 is a longitudinal cross-section taken vertically through a new and improved tap incorporating the unique features of the present invention, the tap being shown attached to a Sankey-type keg fitting.

As shown in the drawings for purposes of illustration, the invention is embodied in a tap 15 for dispensing beer or other beverage from a keg (not shown) whose top wall is equipped with a fitting 18 which, in this particular instance, is a fitting known as a U.S. Sankey-type fitting. Fittings of this type are made in the United States by Draft Systems, Inc. of Northridge, Calif.

The fitting 18 as such is well known and will be described only briefly herein. In general, the fitting includes a tubular neck 20 whose upper end portion projects upwardly from the top wall of the keg. A radially outwardly projecting peripheral lip 21 is formed around the upper end portion of the neck 20, the lip typically coacting with keg cleaning and filling equipment at the brewery.

The lower end portion of the fitting 18 is located in the keg adjacent the top wall thereof. A ball seat 22 made of elastomeric material is normally urged upwardly to a sealed position against the lower end of the neck by a spring (not shown). The ball seat receives a ball valve 24 which normally is urged upwardly to a closed position in the seat by a spring (not shown). When the ball is forced downwardly away from the seat, beer is permitted to flow upwardly past the ball and out of the keg. Opening of the ball seat 22 from the lower end of the neck 20 permits pressurized gas (either air or $CO_2$) to be introduced into the keg in order to force the beer out of the keg.

The tap 15 includes a plastic upper body 26 whose lower end is formed with a probe 27 having a passage 28 and a cross-slot 30. When the probe is inserted into the neck 20, its lower end engages the ball 24 and telescopes into the ball seat 22 to force the ball downwardly away from the seat to its open position. Beer escapes past the open ball, flows into the cross-slot 30 and then flows out of the passage 28 to a beer line 31 connected into the tap body 26 and carrying a dispensing faucet 32. An elastomeric washer 33 on the lower end portion of the probe 27 engages the upper end of the ball seat 22 shortly after the probe opens the ball 24. The washer seals against the top of the valve seat 22 while pushing the ball seat downwardly from the lower end of the neck 20 to permit pressurized gas to be injected into the keg.

In the present instance, pressurized air is introduced into the keg by means of a reciprocating hand-operated pump 35 whose lower end is adapted to be screwed into a threaded sleeve 36 in the upper end of the tap body 26.

When the pump is operated, pressurized air is force downwardly through a passage 38 in the body and flows into the keg via the annular gap between the open ball seat 22 and the lower end of the neck 20. A check valve 40 prevents beer from flowing into the pump 35. In lieu of the pump, a pressurized cylinder of carbon dioxide may be connected to the sleeve 36 of the tap in order to force beer from the keg.

In order to prevent fluid from leaking between the tap 15 and the fitting 18, the lower end portion of the tap body 26 carries an annular skirt 42 which is made of elastomeric material and which is adapted to seal against the inside of the neck 20. The skirt is sized to be pressed into sealing engagement with the inside of the neck 20. Herein, the washer 33 is integral with the skirt 42 so that the two form a composite seal 43 of the type disclosed in my U.S. application Ser. No. 662,017, filed Feb. 28, 1991.

In accordance with the present invention, the upper body 26 of the tap 15 is pivotally connected to a lower body 46 which is adapted to slide radially onto the neck 20 of the fitting 18 and to engage beneath the lip 21 of the neck. Once the lower body 46 has been slid onto the neck, the upper body 26 is pivoted downwardly to insert the probe 27 into the neck and to cause the probe to force the ball seat 22 and the ball valve 24 to their open positions. Final downward pivoting of the upper body automatically latches the upper body in fixed relation with the lower body and, as an incident thereto, the lower body becomes securely clamped to the lip 21.

Figure 8:
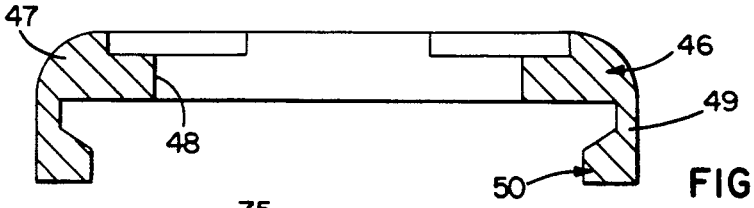
FIG. 8 is an enlarged fragmentary cross-section taken substantially along the line 8—8 of FIG. 2.

More specifically, the lower body 46 preferably is molded of plastic and includes a generally horizontal top wall 47 (FIG. 8) having a vertically extending and generally circular opening 48 formed therethrough. A peripheral skirt 49 is molded integrally with and depends from a portion of the top wall 47. Formed integrally with and projecting radially inwardly from the lower end portion of the skirt is rib means which, in this particular instance, is in the form of a continuous rib 50. The upper surface of the rib is inclined downwardly and inwardly at substantially the same angle as the lower surface of the lip 21 on the neck 20.

Figure 5:
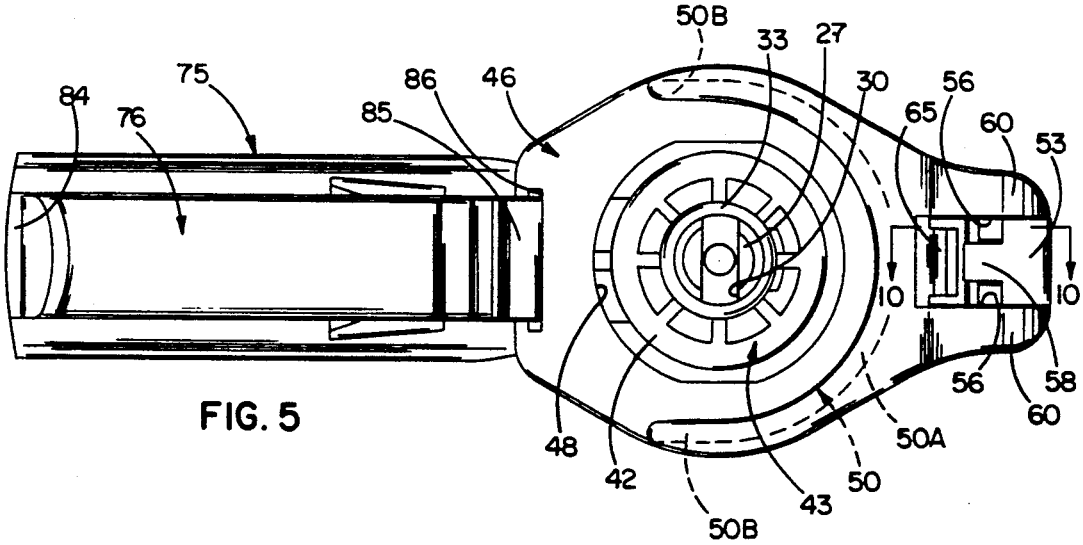
FIG. 5 is a bottom plan view of the tap.
Figure 6:
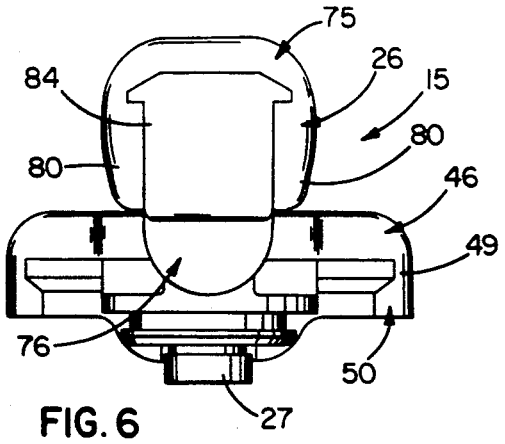
FIG. 6 is an end view as seen from the left of FIG. 4, the seal on the probe being omitted.
Figure 7:
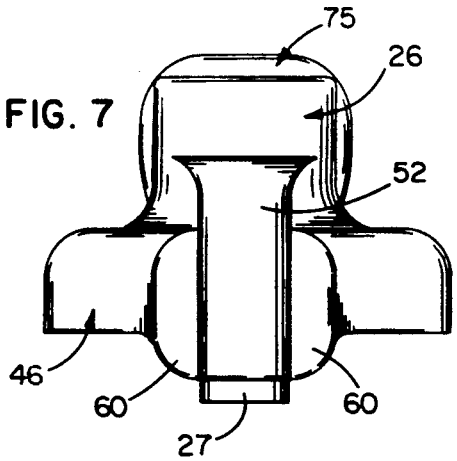
FIG. 7 is an end view similar to FIG. 6 but as seen from the right of FIG. 4.

As shown in FIG. 5, the rib 50 defines a substantially C-shaped undercut retainer which coacts with the lip 21 to hold the lower body 46 on the neck 20. Thus, the rib includes an arcuate front section 50A concentric with the opening 48 and extending through an arc of approximately 180 degrees. Extending from the ends of the arcuate rib section 50A are two relatively short rib sections 50B which are substantially straight and parallel.

With the foregoing arrangement, the lower body 46 may be attached loosely to the neck 20 by placing the rear portion of the top wall 47 on the upper end of the neck and by sliding the lower body radially of the neck to cause the C-shaped rib 50 to move into embracing relation with the neck and into underlying relation with the lip 21. The upper side of the rib 50 engages the lower side of the lip 21 to prevent upward movement of the lower body 46 while the lower side of the top wall 47 rests on the upper end of the neck to support the lower body on the neck.

The upper body 26 of the tap 15 is attached pivotally to the lower body 46 and thus becomes loosely connected to the neck 20 when the lower body is slid radially onto the neck. While the pivot connection between the upper and lower bodies may be formed by various means, the pivot connection preferably is established by slipping a portion of the lower body into a portion of the upper body and then by turning the lower body relative to the upper body to prevent separation of the two interfitting portions.

For this purpose, the forward end portion of the upper body 26 is formed with a downwardly and forwardly extending nose 52 (FIG. 10) whose lower end terminates in a sleeve 53 having a laterally extending and circular bore 54 formed therein. Two laterally spaced slots 56 of rectangular cross-section are formed radially through the lower rear portion of the sleeve 53 and lead into the bore 54 from the outside of the sleeve. The slots are separated by a center tongue or tab 58 (FIG. 5) which is defined by part of the sleeve.

Figure 4:
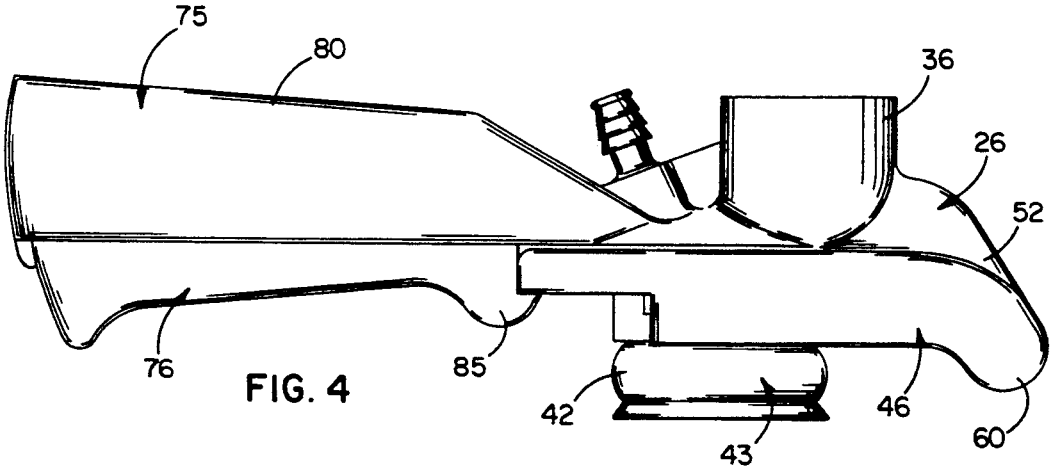
FIG. 4 is a side elevational view of the tap.

The forward end portion of the lower body 46 is molded with two downwardly and forwardly extending ears 60 (FIGS. 4, 5 and 11) which are spaced laterally from one another and straddle the ends of the sleeve 53. Formed integrally with and extending laterally from each ear is a generally rectangular pivot member or trunnion 62 (FIGS. 10 and 11) whose smaller rectangular dimension is somewhat less than the circumferentially extending dimension of the adjacent slot 56 and whose larger rectangular dimension is significantly greater than the circumferentially extending dimension of the slot.

Figure 11:
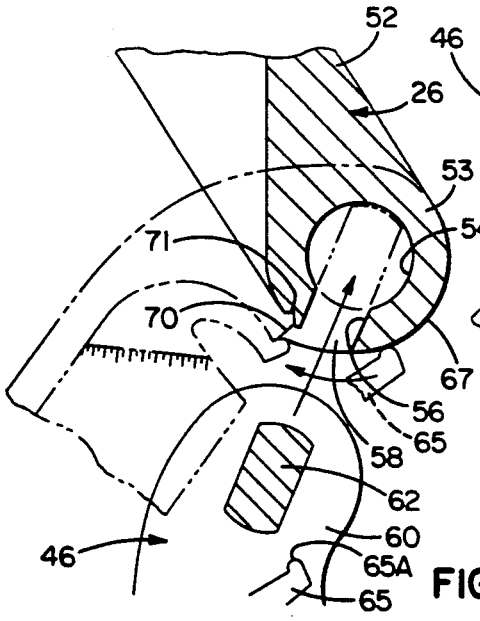
FIG. 11 is a view similar to FIG. 10 but shows the components prior to assembly.

To assemble the upper body 26 to the lower body 46, the two bodies are oriented angularly relative to one another as shown in FIG. 11 and, in this orientation, the trunnions 62 are positioned such that they may be slipped through the slots 56 and into the bore 54 in the sleeve 53. As the trunnions 62 move through the slots 56, a cantilevered detent finger 65 engages an eccentric outer side 67 of the sleeve 53 forwardly of the slots (see FIG. 11). The finger is molded integrally with the forward portion of the lower body 46 and is centered between the rear portions of the ears 60.

Figure 10:
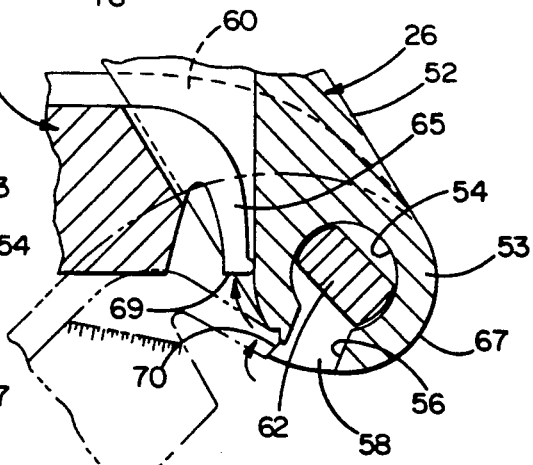
FIG. 10 is an enlarged fragmentary cross-section taken substantially along the line 10—10 of FIG. 5.

Once the trunnions 62 have been inserted through the slots 56 and into the bore 54, the lower body 46 is turned clockwise relative to the upper body 26 to rotate the trunnions to the position shown in FIG. 10. In this position, the long dimension of each trunnion is located crosswise of the respective slot so as to prevent the trunnion from moving out of the slot while permitting the trunnion to rotate in the bore 54.

As the lower body 46 is turned clockwise relative to the upper body 26, the resilient detent finger 65 is cammed outwardly by the eccentric outer surface 67 of the sleeve 53 and, with continued clockwise turning, moves to the position shown in FIG. 10 in engagement with the rear surface of the sleeve. Assembly of the lower body 46 with the upper body 26 is now complete. If the lower body is then turned counterclockwise relative to the upper body (or if the upper body is turned clockwise relative to the lower body), a flat 69 (FIG. 10) on the end of the detent finger 65 engages a detent shoulder 70 on the tongue 58 of the sleeve 53 and prevents relative turning of the two bodies to position in which the trunnions 62 may slip out of the slots 56.

Thus, the two bodies 26 and 46 may be pivotally connected simply by slipping the trunnions 62 into the bore 54 via the slots 56 and then by turning the lower body clockwise relative to the upper body. Once the bodies are assembled, coaction of the detent finger 65 with the detent shoulder 70 prevents reverse turning of the lower body to such an extent as to permit disassembly and thus the two bodies are held in permanently assembled relation.

Figure 2:
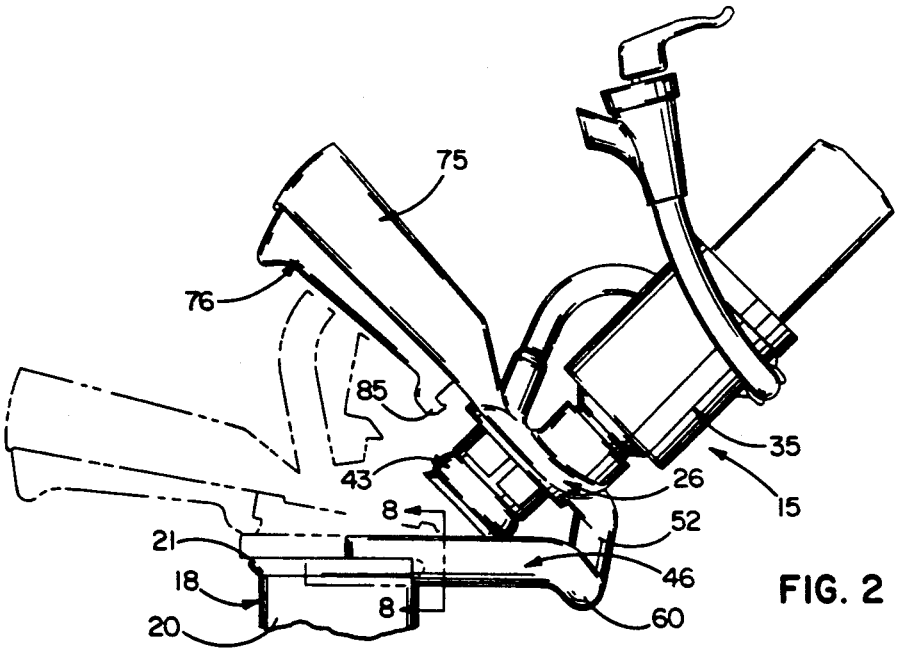
FIG. 2 is a reduced side elevational view showing the tap being installed on the fitting.

The pivot connection between the two bodies 26 and 46 enables the upper body to be swung from a pretapping position shown in solid lines in FIG. 2 to a tapping position shown in FIG. 1. When the upper body is in its pretapping position, the seal 43 is located well above the neck 20 and thus enables the lower body 46 to be slid radially onto the neck from the position shown in solid lines in FIG. 2 to the loosely installed position shown in phantom lines. Advantageously, a nib 65A (FIG. 11) on the end of the detent finger 65 engages in a detent groove 71 in the tongue 58 and releasably holds the upper body in its pretapping position to guard against the seal 43 being pinched against the neck as the lower body is slid to its loosely installed position.

When the lower body 46 is in its loosely installed position, the probe 27 and the seal 43 are located directly above the neck 20 and thus, when the upper body is swung counterclockwise to its tapping position, the probe moves downwardly into the neck via the opening 48 in the lower body and opens the ball seat 22 and the ball valve 24 as shown in FIG. 1. To facilitate swinging of the upper body 26 relative to the lower body 46, an elongated handle 75 is molded integrally with and projects rearwardly from the upper body. The handle is hollow, is of inverted U-shaped cross-section, and includes a lower open side.

Figure 9:
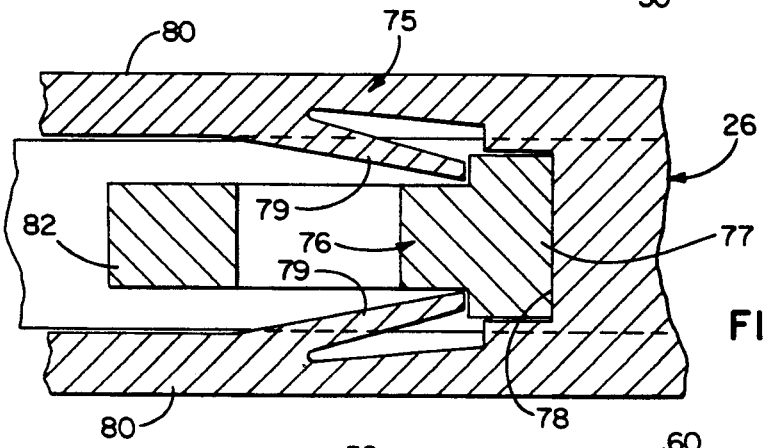
FIG. 9 is an enlarged fragmentary cross-section taken substantially along the line 9—9 of FIG. 1.

Means are provided for releasably latching the upper body 26 to the lower body 46 to hold the upper body in its tapping position. Herein, these means comprise a latching lever 76 which is nested within and is pivotally connected to the handle 75. The latching lever 76 is a one-piece member molded of plastic and is formed with a cylindrical pivot rod 77 (FIGS. 1 and 9) adjacent its forward end. When the lever is inserted endwise into the handle from the open rear end of the handle, the pivot rod 77 moves into and seats within an arcuate pivot seat 78 formed in the upper forward portion of the interior of the handle 75. As the lever is slid into the handle, the ends of the pivot rod 77 cam past and deflect outwardly two resiliently yieldable fingers 79 (FIG. 9) formed integrally with the inner sides of the side walls 80 of the handle. Once the ends of the rod 77 clear the fingers 79, the latter snap inwardly behind the rod to hold the rod in assembled relation with the seat 78.

Accordingly, the pivot rod 77 and the seat 78 coact to permit the latching lever 76 to pivot upwardly and downwardly relative to the handle 75 about a horizontal axis extending parallel to the pivot axis between the upper and lower bodies 26 and 46. The fingers 79 enable the lever to be assembled to the handle with a snap-in action and, once the assembly is complete, the fingers engage the pivot rod 77 to prevent disassembly of the lever from the handle.

The latching lever 76 is biased downwardly relative to the handle 75. For this purpose, the latching lever includes a lower handle or gripping section 81 (FIG. 1) and further includes an integral cantilevered spring section 82 spaced upwardly from the gripping section. The forward end portion of the spring section is joined to the gripping section while the rear end portion of the spring section bears against the underside of the top wall 83 of the handle and urges the latching lever to pivot downwardly or counterclockwise about the axis of the pivot rod 77. A plate 84 is molded integrally with and depends from the rear end portion of the spring section 82 and closes the rear end of the handle 75. When the handle 75 is gripped and the gripping section 81 of the lever 76 is squeezed upwardly, the spring section 82 flexes to enable the gripping section to move upwardly into the handle with the rear end of the gripping section moving upwardly alongside the plate 84. When the gripping section is released, the spring section urges the latching lever downwardly from the handle until a stop surface 84B on the lever engages a stop lug 84A on the handle. The spring section thus is maintained in a preloaded condition when the gripping section is released.

Figure 3:
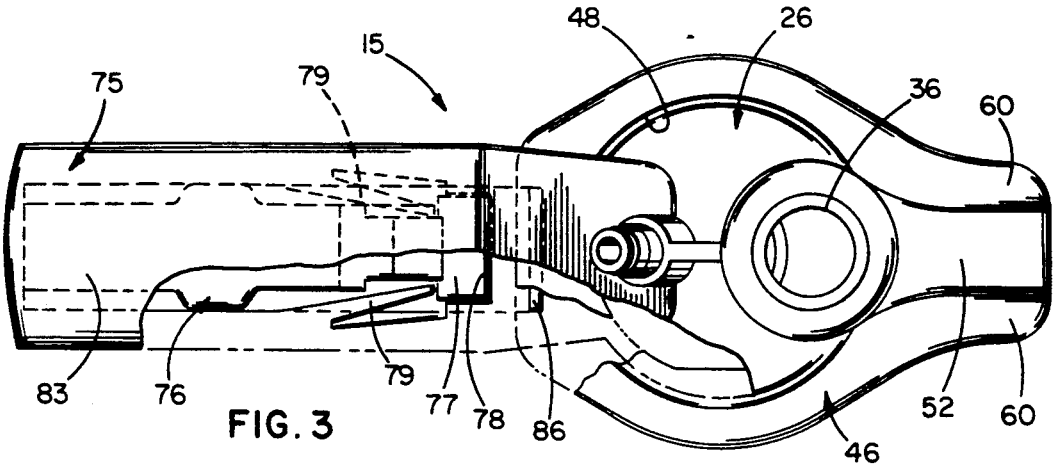
FIG. 3 is a top plan view of the tap shown in FIG. 1, certain parts of the tap being broken away for clarity.

A latching lug 85 (FIG. 1) is molded integrally with the lower forward end portion of the latching lever 76 and is adapted to seat releasably in a laterally extending groove 86 (FIGS. 1 and 5) in the lower rear portion of the lower body 46 in order to latch the upper body 26 to the lower body and hold the upper body downwardly in its tapping position. When the upper body is swung downwardly toward its tapping position, a portion of the latching lug 85 cams against a downwardly inclined surface 88 (FIGS. 1 and 3) on the upper side of the rear portion of the lower body. Such camming momentarily pivots the latching lever 76 clockwise against the action of the spring section 82 to permit the latching lug 85 to move past the cam surface 88. Once the lug clears the cam surface, the spring section 82 pivots the lever 76 counterclockwise and causes the lug to snap into and latch within the groove 86. Because of the preload in the spring section, it tends to urge the lug upwardly into the groove and thereby latch the upper body securely to the lower body.

To summarize, the tap 15 is installed on the neck 20 while the upper body 26 is pivoted upwardly relative to the lower body 46 and is located in its pretapping position shown in solid lines in FIG. 2. The flat 69 on the detent finger 65 engages the shoulder 70 on the tongue 58 to prevent the upper body from swinging clockwise beyond the pretapping position shown in FIG. 2.

With the upper body 26 in its pretapping position, the lower body 46 is slid radially onto the neck 20 and is moved from the position shown in solid lines in FIG. 2 to the position shown in phantom lines. As an incident thereto, the C-shaped rib 50 slides beneath the lip 21 of the neck and, at the same time, the probe 27 and the seal 43 are brought to a position over the neck.

Thereafter, the upper body 26 is swung downwardly or counterclockwise to its tapping position. During such swinging, the probe 27 moves through the opening 48 and into the neck 20 and begins to open the ball seat 22 and the ball valve 24. In addition, the latching lug 85 cams against the inclined surface 88 as shown in phantom lines in FIG. 2.

With final downward swinging of the upper body 26, the probe 27 effects full opening of the ball seat 22 and ball valve 24. The latching lug 85 automatically snaps into the detent groove 86 and secures the upper and lower bodies 26 and 46 in fixed relation to one another. The tap 15 is held securely on the neck 20 by virtue of the springs of the ball seat and the ball valve urging the tap upwardly to force the upper side of the rib 50 into tight frictional engagement with the lower side of the lip 21.

Removal of the tap 15 is effected simply by gripping the handle 75 and the gripping section 81 of the latching lever 76 and by squeezing upwardly on the gripping section to pivot the latching lug 85 out of latching relation with the groove 86. Thereafter, the upper body 26 is swung upwardly to pull the probe 27 out of the neck 20 and, as the final step, the lower body 46 is slid radially off of the neck.

From the foregoing, it will be apparent that the present invention brings to the art a new and improved beverage tap 15 which requires only three basic components, namely, the upper body 26, the lower body 46 and the latching lever 76. These components all may be made of plastic and may be assembled without need of separate fasteners or the like. Thus, the tap may be manufactured and assembled at relatively low cost.

Because the valve seat 22 and the ball valve 24 are opened by swinging the upper body 26 downwardly, the probe 27 is capable of being moved through a relatively long opening stroke so as to insure full opening of the valve means. As a result, the tap lends itself well to use with $CO_2$ cylinders and thus may be used successfully as a commercial tavern tap as well as a picnic tap.

Installation and removal of the tap 15 may be achieved quickly and easily by using a sliding motion combined with a pivoting motion. If a person grabs the handle 75 in an effort to lift the keg, the latching lever 76 automatically releases the upper body 26 from the lower body 46 and prevents lifting of the keg with the tap.

I claim:

1. A tap for a container having an upstanding tubular neck with a radially outwardly projecting peripheral lip at its upper end, the inside of said neck having normally closed valve means which may be opened to permit pressurized fluid to be introduced into said container and to permit liquid to flow out of said container, said tap comprising a lower body having rib means configured to engage beneath said lip and hold said lower body on said neck, said rib means defining a generally C-shaped retainer permitting said lower body to be slid radially onto said neck with said rib means sliding beneath said lip, said tap further comprising an upper body, pivot means pivotally connecting said upper body to said lower body and supporting said upper body to swing upwardly and downwardly relative to said lower body about a generally horizontal axis between a pretapping position and a tapping position, means extending downwardly from said upper body for opening said valve means, said valve opening means clearing said neck when said upper body is in said pretapping position and as said lower body is slid radially onto said neck, said valve opening means moving downwardly into said neck and opening said valve means when said lower body is on said neck and when said upper body is swung downwardly to said tapping position, and latching means on one of said bodies and releasably engaging the other body to hold said upper body downwardly in said tapping position.

2. A tap as defined in claim 1 in which said lower body comprises a generally horizontal top wall having an opening extending vertically therethrough for receiving said valve opening means when said upper body is in said tapping position, a skirt formed integrally with and depending from a portion of said top wall, said rib means projecting inwardly from the lower margin of said skirt and being spaced below said top wall.

3. A tap as defined in claim 2 in which said rib means include an arcuate section extending through an arc of approximately 180 degrees and further include substantially straight and parallel sections extending from the ends of said arcuate section.

4. A tap as defined in claim 3 in which said pivot means are located adjacent the arcuate section of said rib means and extend substantially perpendicular to said straight sections.

5. A tap as defined in claim 1 further including an elongated handle projecting from said upper body, said latching means comprising a latching lever located on the lower side of said handle and pivotally connected to said handle to swing upwardly and downwardly about a generally horizontal axis extending parallel to said one axis, and a latch carried by said lever and adapted to cam past and lock beneath said lower body when said upper body is swung downwardly to said tapping position, said latch releasing said lower body when said latching lever is swung upwardly toward said handle.

6. A tap as defined in claim 5 in which said handle is hollow and includes an open lower side, said latching lever being nested within said handle.

7. A tap as defined in claim 6 in which said handle is molded of plastic and resiliently yieldable fingers molded integrally with said handle and engaging said latching lever to hold said lever and said handle in assembled relation.

8. A tap as defined in claim 1 in which said pivot means include a sleeve formed integrally with said upper body and defining a generally circular bore, radially extending slot means formed through said sleeve and communicating with said bore, generally rectangular pivot member means formed integrally with said lower body and adapted to be inserted into said bore through said slot means when said lower body is in a first angular orientation relative to said upper body, said pivot member means engaging said sleeve and being prevented from moving out of said slot means when said lower body is turned in one direction to a second angular orientation relative to said upper body, and detent means on said upper and lower bodies and coacting to prevent said lower body from returning to said first angular orientation once said lower body has been turned to said second angular orientation.

9. A tap for a container having an upstanding tubular neck with a radially outwardly projecting peripheral lip at its upper end, the inside of said neck having normally closed valve means which may be opened to permit pressurized fluid to be introduced into said container and to permit liquid to flow out of said container, said tap comprising a lower body having rib means configured to engage beneath said lip and hold said lower body on said neck, said rib means defining a generally C-shaped retainer permitting said lower body to be slid radially onto said neck with said rib means sliding beneath said lip, said tap further comprising an upper body having a handle projecting from one end portion thereof, pivot means pivotally connecting the opposite end portion of said upper body to said lower body and supporting said upper body to swing upwardly and downwardly relative to said lower body about a generally horizontal axis between a pretapping position and a tapping position, means extending downwardly from said upper body for opening said valve means, said valve opening means clearing said neck when said upper body is in said pretapping position and as said lower body is slid radially onto said neck, said valve opening means moving downwardly into said neck and opening said valve means when said upper body is swung downwardly to said tapping position, a latching lever pivotally connected to said handle to swing about an axis paralleling said one axis, and latching means on said latching lever and automatically latching against said lower body when said upper body is swung downwardly to said tapping position thereby to hold said upper body in said tapping position.

10. A tap as defined in claim 9 further including spring means formed integrally with said latching lever and engaging said handle to cause said latching lever to pivot toward a latched position.

* * * * *